US006230761B1

(12) United States Patent
Richard et al.

(10) Patent No.: US 6,230,761 B1
(45) Date of Patent: May 15, 2001

(54) INJECTION SYSTEM

(75) Inventors: Robert Gerard Richard; Rajiv Ratna Singh, both of Eric County, NY (US); Austin Verge Pranke, Morris County, NJ (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/262,410

(22) Filed: Mar. 4, 1999

(51) Int. Cl.[7] ..... B65B 1/04
(52) U.S. Cl. ..... 141/18; 141/9; 141/104
(58) Field of Search ..... 141/9, 69, 105, 141/107, 104, 100; 222/144.5, 145.1, 145.5; 62/77, 292

(56) References Cited

U.S. PATENT DOCUMENTS 3,937,029 * 2/1976 Grahl et al. ..... 62/77
4,745,772 * 5/1988 Ferris ..... 62/292
4,930,666 * 6/1990 Rudick ..... 141/360
4,938,063 * 7/1990 Leighley ..... 73/40.7
5,167,140 * 12/1992 Cooper et al. ..... 73/40.7
5,234,268 * 8/1993 Homan ..... 366/161
5,293,909 * 3/1994 Weiss ..... 141/9
5,868,177 * 2/1999 Leahy et al. ..... 141/9

* cited by examiner

*Primary Examiner*—Steven O. Douglas
*Assistant Examiner*—Khoa Huynh
(74) *Attorney, Agent, or Firm*—Colleen D. Szuch; Marie L. Collazo

(57) ABSTRACT

An injection system for injecting one or more additives into a pressurizable container for use with a filling system providing a flow of fluid into the pressurizable container, the injection system comprising: (a) a delivery system adapted for transferring at least one additive from a source of the additive to at least one portal; and (b) at least one portal operatively connectable between the delivery system and the filling system, the portal defining an internal space and having at least a first configuration and a second configuration, in the first configuration, the internal space being adapted to receive additives from the delivery system while being fluidly isolated from the filling system, in the second configuration, the internal space being in fluid communication with the filling system such that any additive deposited therein is carried into the container by the flow of fluid provided by the filling system.

21 Claims, 2 Drawing Sheets

INJECTION SYSTEM

FIELD OF INVENTION

The present invention relates generally to the filling of pressurizable containers. More specifically, the present invention relates to the introduction of additives, such as oils, surfactants, stabilizers, dyes and odor agents, during the filling of pressurizable containers.

BACKGROUND OF THE INVENTION

Containers of pressurized fluid are ubiquitous in a modern society and include, for example, jugs of refrigerant for charging refrigeration systems and tanks of propane for heating. Such containers typically are charged under pressure using a filling system. A conventional filling system comprises a central tank for storing the fluid, conduit for connecting the central tank to one or more filling stations, one or more pumps to motivate fluid flow toward the fill station(s), and typically a programmable controller for controlling the filling system's operation. A conventional filling system tends to be a specialized apparatus, and, as such, tends to represent a significant capital expenditure. Therefore, to maximize its utility, a filling system usually is configured to accommodate a number of fill stations, thereby increasing the number of containers that can be filled at a given time. To this end, the conduit usually comprises a common section from which a number of leader sections extend, each leader section supplying a particular fill station. In operation, the filling system initially pulls a vacuum to evacuate residual fluids, impurities and/or air from each container connected to a fill station. Once the containers have been evacuated, the system transfers fluid from the central tank to the individual containers at relatively high pressure, for example, usually between 50 psi and 2000 psi.

Aside from the fluid, it is often preferable to introduce one or more additives to the container. As used herein, an "additive" is any substance that is added to the container to render the fluid detectable to the senses, to improve the performance of the fluid, or to improve performance of apparatus using the fluid. Such additives are well known in the art. For example, dyes may be added to refrigerants and other fluids used in circulating systems to provide operators with a visual indication of a leak so as to avoid an unnecessary atmospheric release of the fluid and to keep the system operational. In situations where the fluid is explosive or toxic and the early detection of a leak thereof is critical to minimizing danger, an odor agent such as a mercaptan can be added to the container. It also may be preferable to add oil or other lubricants to fluids used in machinery having wearing components such as refrigeration units.

One approach to introducing an additive to a pressurizable container is to mix it in the central tank of a filling system and then use the filling system to distribute the fluid/additive mixture through the conduit to the various containers. Such an approach is appealing because it uses the existing filling system to pump the additives to all the containers. Additionally, it allows the additives to be mixed with the fluid in bulk fashion and distributed among the individual containers during the course of ordinary filling. Unfortunately, although efficient, this approach tends to contaminate the filling system with the additives. This is particularly problematic since a common filling system usually is employed to fill containers with a variety of different fluids, some of which not only do not require such additives, but are compromised by such additives. For example, it is generally preferred that fluids such as alcohol, kerosene, and water remain crystal clear so as to ensure their purity. Color in the fluid may serve to mask or suggest an impurity.

Another approach to introduce additives in pressurizable containers is to have a dedicated fill station for a particular fluid and a combination of additives. Although this takes advantage of a centralized facility for injecting additives and avoids the problem of contamination mentioned above, the expense of a dedicated system is prohibitive and renders such an approach impractical. Also, seasonal products, such as refrigerants and propane tanks, are commonly filled during "campaigns," in which many cylinders are filled in a relatively short time span, thus necessitating many filling stations.

Therefore, a need exists for a system and method of supplying additives to a pressurizable container that can be used with an existing system, but which avoids contaminating the filling system. The present invention fulfills this need among others.

DESCRIPTION OF THE INVENTION AND PREFERRED EMBODIMENTS

Figure 1:
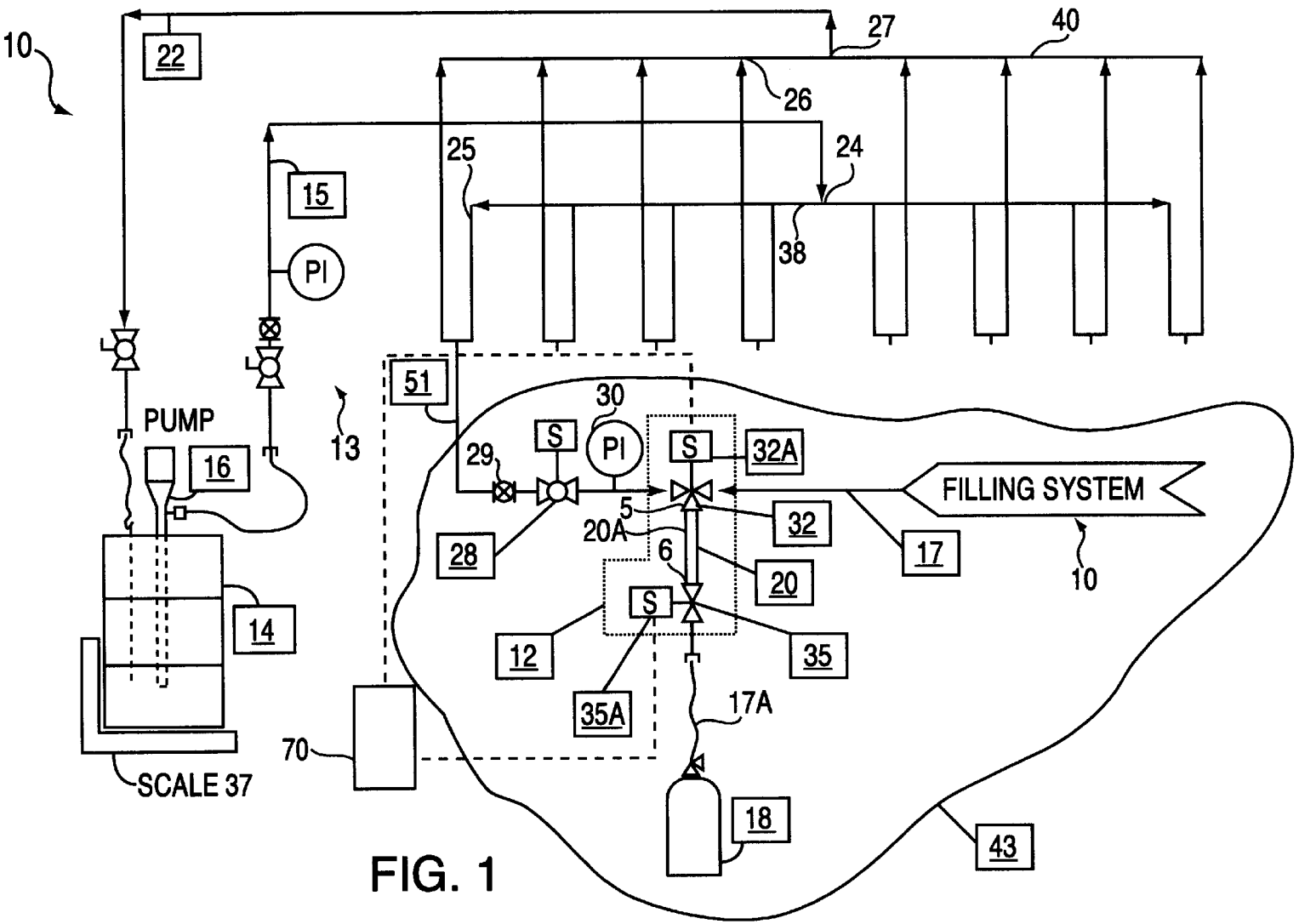
FIG. 1 is a schematic diagram of a preferred embodiment of the injection system of the present invention integrated with a conventional filling system.

The present invention provides for the introduction of one or more additives in a container by introducing the additives through a portal in a filling system. The portal functions to receive one or more additives and then to facilitate their transfer into one or more containers by exposing them to the flow of fluid provided by the filling system. Thus, the present invention uses ordinary fluid flow in the filling system to carry the additives into the container. Furthermore, the invention uses the fluid flow to flush the filling system clean of the additives, thereby eliminating any contamination resulting from the filling system's exposure to the additives. Contamination can be reduced further by locating the portal near the container to minimize the filling system's exposure to the additives.

One aspect of the invention is an injection system for delivering one or more additives into a pressurizable container for use with a filling system adapted for providing a flow of fluid into the pressurizable container. In a preferred embodiment, the injection system comprises: (a) a delivery system adapted for transferring at least one additive from a source of the additive to at least one portal; and (b) at least one portal operatively connectable to the filling system and the delivery system, the portal defining an internal space and having at least a first configuration and a second configuration, in the first configuration, the internal space is in fluid communication with the delivery system to receive additive therefrom while being fluidly isolated from the filling system, in the second configuration, the internal space is in fluid communication with the filling system such that any additive deposited therein is carried into the container by the fluid flow provided by the filling system.

Another aspect of the invention is a portal as described above adapted for integration with an existing filling system. In a preferred embodiment, the portal comprises an upstream connection point adapted for connection to conduit of a filling system and a downstream connection point adapted for connection to the conduit downstream of the upstream connection point.

Still another aspect of the invention is a delivery system adapted for interfacing with one or more portals. In a preferred embodiment, the delivery system comprises: (a) a tank adapted to store one or more additives; (b) delivery conduit adapted to connect the tank to one or more portals; and (c) a transfer device adapted to transfer the additives from the tank to the portal(s).

Yet another aspect of the invention is a mobile delivery system adapted for interfacing a portal. In a preferred embodiment, the portable delivery system comprises: (a) a movable platform; (b) a tank mounted on the platform and adapted to store one or more additives; (c) delivery conduit adapted to connect the tank to a portal; and (d) a transfer device adapted to transfer the additives from the tank to the portal.

A further aspect of the invention is a method for injecting one or more additives in a container using an existing filling system. In a preferred embodiment, the process comprises: (a) configuring a portal in a first configuration such that its internal space is sealed from the filling system and is in fluid communication with the delivery system; (b) facilitating deposition of the additive in the internal space of the portal preferably by maintaining the portal in the first configuration for a sufficient time to allow the delivery system to deposit the additive into the internal space; and (c) configuring the portal in a second configuration such that it is sealed from the delivery system and in fluid communication with the filling system, thereby allowing any additive deposited in the internal space to be carried into the container by the flow of fluid provided by the filling system.

Further, another aspect of the invention is a controller configured to control the configurations of a portal to effect the process described above.

Referring to FIG. 1, a preferred embodiment of the present invention is shown integrated with a conventional filling system 10. As mentioned above, a conventional filling system typically comprises one or more tanks for blending and storing the fluid(s). The fluid is pumped from the storage tanks to the filling stations via a conduit system. A typical conduit system comprises a main conduit line operatively connecting to the central tank(s), the pumps, and a plurality of leader sections. Each leader section is connectable to a single container. A filling system also comprises a programmable controller to control the evacuation of the containers and to transfer the fluid from the central tank through the conduit system and into the individual containers.

The injection system of the present invention interfaces with the filling system along the leader section 17 as shown in FIG. 1. The injection system comprises a portal 12 operatively connected to a leader section 17 and a delivery system 13 operatively connected to the portal 12. Although the injection system of the present invention may be interfaced with the filling system at any point along the conduit system, preferably it is connected to a leader section to minimize the filling system's exposure to the additives. In other words, rather than systemically exposing the filling system to the additives, only the portion of the leader section 17*a* downstream of the portal is exposed. Additionally, this configuration allows other fill stations (not shown) to be used independently from the injection system.

The portal 12 functions to receive the additives from the delivery system and then to facilitate their transfer into the container(s) by exposing them to the flow of fluid provided by the filling system. Suitable portals include any device capable of interfacing a certain volume between two or more systems without, at any time, connecting the systems. This way, the systems remain separate, allowing them to contain different materials at different conditions (e.g., pressure and temperature). To achieve this functionality, the portal preferably has an internal space and at least two configurations. In the first configuration, the internal space is adapted to receive additives from the delivery system while being fluidly isolated from the filling system. In the second configuration, the internal space is in fluid communication with the filling system such that any additive deposited therein is carried into the container by the fluid flow provided by the filling system. The following is merely representative of suitable portals having the above-mentioned functionality:

(1) Devices having: (a) a chamber connected to two or more systems; and (b) valving for alternately connecting the chamber to one of the systems.

(2) Devices having (a) a vessel having a circular cross-section and one or more radially-disposed orifices therein; and (b) a sleeve rotatably mounted around the vessel and having radially-disposed ports connected to two or more systems. The vessel being in fluid communication with a system when the vessel or the sleeve is rotated such that an orifice of the vessel aligns with the port of the sleeve connected to the system.

(3) Devices having (a) a vessel having a circular cross section and a plurality of radially-disposed ports connected to two or more systems; and (b) a rotor disposed within the vessel defining one or more fluid channels within the vessel depending upon its radial position relative to the vessel. The vessel being in fluid communication with a system when the fluid channel defined by the rotor includes the port(s) connected to the system.

(4) Devices having (a) a vessel connected to two or more systems; and (b) interlocking, movable partitions therein for alternately connecting the vessel to one of the systems to facilitate fluid communication therebetween.

In FIG. 1, a preferred embodiment of the portal 12 is shown. A preferred embodiment of portal 12 comprises a chamber 20, which defines an internal space 20*a* and is connected at an upstream end 5 by a first valve 32 and at a downstream end 6 by second valve 35. In this embodiment, the first valve 32 is a three-way valve connected to the delivery system 13, the filling system 10 along the leader section 17, and the chamber 20. The first valve 32 has two positions. In the first position, delivery system 13 is in fluid communication with the chamber 20, and, in the second position, the filling system 10 is in fluid communication with the chamber 20. Although a three-way valve is shown in FIG. 1, it is well known that two two-way valves can accomplish the same function. Specifically, one two-way valve can connect the filling system to the chamber, another two-way valve can connect the delivery system to the chamber, and the two valves can be interlocked such that only one is opened at a given time. Referring back to FIG. 1, the second valve 35 is a two-way valve having an open and closed position. In the open position, the internal space 20*a* is in fluid communication with a downstream portion of the leader section 17*a* connected to an individual container 18. In the closed position, this fluid communication is interrupted. Although the three-way valve and the two-way valve are shown at the upstream and the downstream ends of the chamber 20, respectively, it is known that their positions may be switched such that a two-way valve connects the upstream end 5 of the chamber with the filling system and the three-way valve connects the downstream end 6 of the chamber with the pressurizable container and the delivery system without affecting the portal's operation.

The portal configuration depicted in FIG. 1 facilitates: (a) the evacuation of the container(s); (b) the introduction of additives into the filling system; and (c) the injection of additives and fluid into container. Specifically, container 18 is evacuated by opening the second valve 35 and disposing the first valve 32 in the second position thereby facilitating fluid communication between the filling system 10 and the container and enabling the filling system to evacuate the container 18. Once the container 18 is evacuated, the second valve 35 is closed and the first valve 32 is switched to the first position thereby establishing fluid communication between the delivery system 13 and the chamber 20 and enabling the delivery system to transfer the additive into the internal space 20*a*. Next, the first valve 32 is switched to the second position thereby reestablishing fluid communication between the filling system 10 and the chamber 20 and the second valve is switched to an open position, thereby allowing the flow of fluid provided by the filling system 10 to carry the additive deposited in the internal space 20*a* into the individual container 18.

The delivery system 13 is configured to deliver the additive to portal 12. Suitable delivery systems include conventional fluid handling systems which are well known in the art. A preferred delivery system 13 is shown in FIG. 1. As shown, a central tank 14 holds the additive and a conduit 15 operatively connects the tank to the portal 12. To transfer the additive from tank 14 to portal 12, a transfer device 16 may be used. In situations where the additive may separate or where mixing is otherwise desirable, the delivery system 13 also may comprise an agitator (not shown) within tank 14 for mixing the additive.

The transfer device 16 may be any known device for moving fluid. Suitable devices include, for example, centrifugal pumps, positive displacement pumps, and any other device which effects a flow of fluid toward the portal 12. Preferably, the transfer device 16 is a pump (either centrifugal or positive displacement) for moving the fluid from tank 14 to portal 12.

The conduit 15 may be any conventional conduit for directing the fluid therein. Preferably, conduit 15 is suitable to be pressurized. More specifically, in the preferred embodiment transfer device 16 is a pressure increasing device, for example, a pump, which pressurizes the conduit downstream thereof. By pressurizing the conduit 15, the additive readily fills the internal space when access to the portal is provided. Pressure-rated conduits are well known in the art.

In a preferred embodiment, especially where the additive benefits from mixing, a return conduit 22 is used to form a circuit with the conduit 15 for unused additive to return to the tank 14. This way, additive is continuously circulated down conduit 15 and back to the tank through conduit 22 where it is reintroduced to the tank 14. Mixers or agitators may be added to achieve more intense mixing.

It also may be preferable to configure the delivery system 13 to handle a plurality of fill stations. More specifically, the delivery system 13 can be configured to interface with two or more of the fill stations supplied by filling system 10. The advantage of this is the same as with the filling system in that a central tank or tanks and transfer device(s) can be used to accommodate a plurality of fill stations, thereby achieving economies of scale.

FIG. 1 is a schematic diagram of the injection system of the present invention adapted to accommodate two or more fill stations 43. More specifically, drum pump 16 is configured to pump the additive from tank 14 through conduit 15 to a plurality of fill stations 43. Each fill station 43 is connected to conduit 15 through a branch conduit 51. The branch conduit 51 comprises a check valve 29 to prevent the back flow of fluid into the delivery system 13 in the event valve 32 malfunctions. An inlet valve 28 downstream of check valve 29 controls the flow of additive in a portion of the branch conduit 51 and a high pressure indicator 30 ensures that the injection system is not over pressurized. The portal 12 is connected at the downstream end of the branch conduit 51. A downstream leader section 17*a* extends from the portal 12 and is operatively connectable to a container 18.

As shown in FIG. 1, conduit 15 connects two or more fill stations and then returns to tank 14 through return conduit 22. Although the fill stations may be connected in series, it is preferable for the fill stations to be connected in parallel. To this end, the delivery system comprises a first manifold 38 having an inlet 24 for receiving additive from the drum pump and a plurality of outlets 25 for supplying branch conduit 51. Each branch conduit 51 supplies a fill station 43 as described above. As mentioned above, it may be preferable in certain circumstances to employ a delivery system which circulates the additive. As shown in FIG. 1, a second manifold 40 is used which has a plurality of inlets 26, each inlet connected to a branch conduit 51, and an outlet 27 connected to a return conduit 22. Accordingly, additive is pumped from tank 14 into the first manifold 38 where the flow is split into branch conduit 51. A portion of the flow passes through the check valve 29 as described above while the remaining portion flows into second manifold 40 where it is combined in return conduit 22 and pumped back to the tank where it can be re-circulated.

Figure 2:
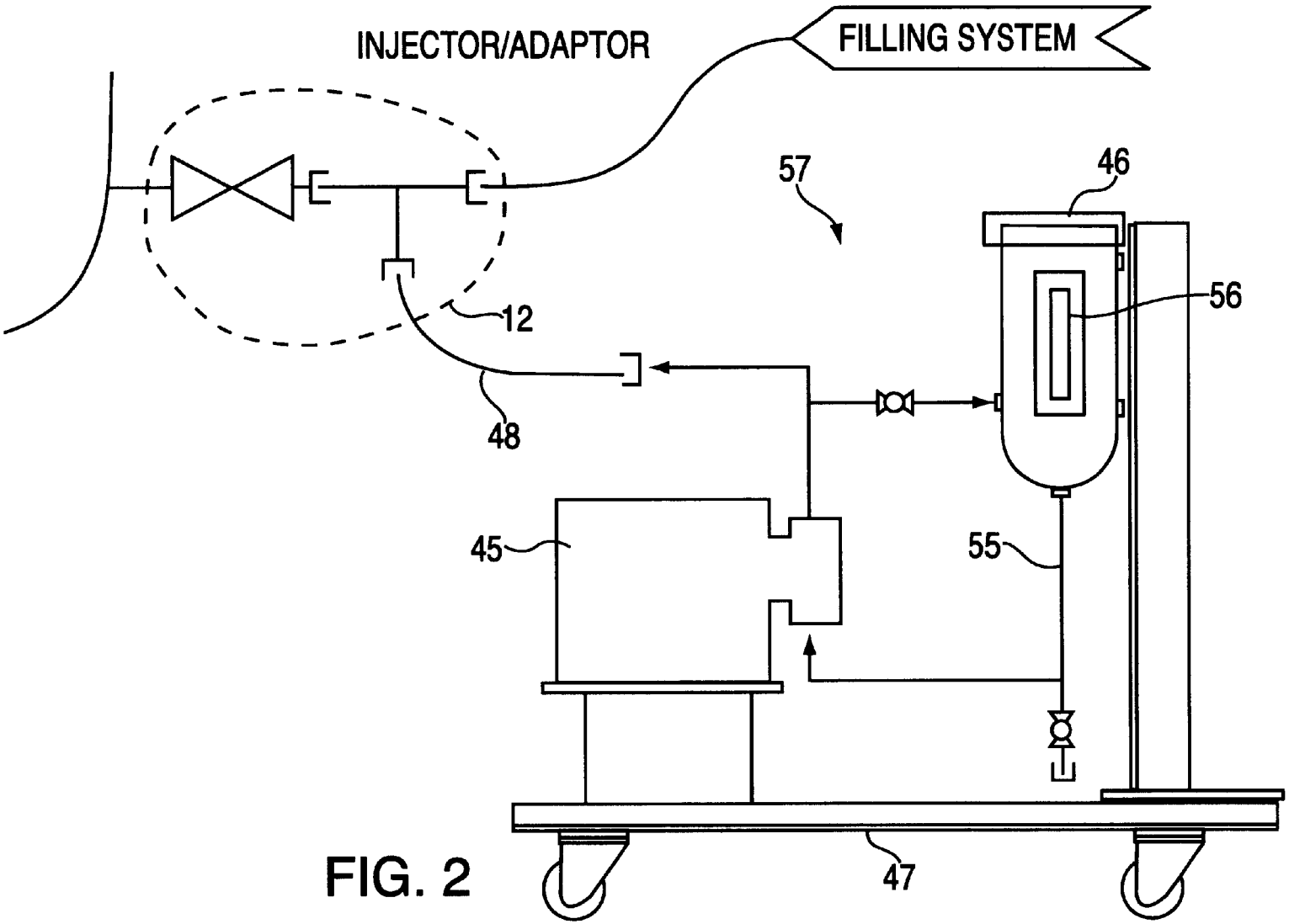
FIG. 2 is a schematic diagram of a preferred embodiment of a mobile delivery system.

Rather than configuring the delivery system 13 to accommodate a plurality of fill stations, a single, mobile delivery system may be used to accommodate a number of individual fill stations. FIG. 2 shows a preferred embodiment of a mobile delivery system. As shown, the mobile delivery system comprises a cart 47 or other known mobile platform on which is mounted a tank 46 operatively connected to a pump 45 by a connector 55. The tank 46 may have a level gauge 56 so that the operator can readily determine the amount of available additive remaining in the tank. A hose 48 is used to connect the pump to the portal 12.

It may be preferable to control the amount of additive introduced into the individual containers. To this end, a metering system may be employed. Suitable metering systems are known in the art and include, for example, devices for controlling flow of fluid, such as a metering pump, and devices for measuring a predetermined amount of fluid, such as a calibrated vessel or a syringe pump.

In a preferred embodiment, a metering system comprises a calibrated portal. More specifically, as depicted in FIG. 1, portal 12 comprises a chamber 20 calibrated such that it delivers a known quantity of additive to the individual containers. The chamber may be calibrated in different ways. For example, graduated marks may be inscribed on the chamber such that an operator can determine the amount of additive deposited therein. Preferably, however, the entire volume of the chamber is calibrated such that, when filled, it contains the desired amount of additive.

Alternatively, a metering pump can be used to limit the flow of additive into the portal to a predetermined amount. For example, the pump 45 equipped with the mobile delivery system 57 depicted in FIG. 2 may be a metering pump.

It may be preferable for the injection system of the present invention to comprise a controller 70 for automatically controlling the injection of additive into the containers. The control functionality may be housed in a discrete controller dedicated to the injection system, but preferably is integrated with the filling system's programmable controller described above. Accordingly, the controller may be adapted to control the filling system, the delivery system, the various configurations of the portals and combinations thereof depending upon the specific structure of the injection system and its integration with the filling system.

As mentioned above, in a preferred embodiment, the delivery system is pressurized such that additive enters the internal space as soon as fluid communication between the portal and the delivery system is established. This embodiment of the delivery system requires little control and operates on demand like tap water. Accordingly, the control of the injection system may be focused on the portal.

For illustrative purposes, the configuration of controller will be described in greater detail with respect to a preferred embodiment depicted in FIG. 1, in which the portal comprises a three-way valve 32 connected to a chamber 20 which in turn is connected to a two-way valve 35. To facilitate remote control of the valves by the controller, valves 32 and 35 have actuators 32*a* and 35*a,* respectively, as shown. Valves actuators are well known in the art and include, for example, air-operated actuators, and electrical solenoid valves. The controller is operatively connected to the actuators and has logic which is integrated or otherwise interfaces with the logic of the filling system to perform the following steps:

(a) configuring the portal 12 in the second configuration by opening the second valve 35 and positioning the first valve 32 in the second position:

(b) facilitating evacuation by maintaining the portal in the second configuration for a time sufficient for the filling system to evacuate the container 18;

(c) configuring the portal 12 in the first configuration by closing the second valve 35 switching the three-way valve 32 to a first position;

(d) facilitating the deposition of additive in the portal by maintaining the portal in the first configuration for a sufficient time to allow the delivery system to fill the calibrated section 20; and (e) facilitating injection of the additive into the container by configuring the portal in the second position by switching the first valve to the second position and opening the second valve, thereby exposing the additive in the chamber to the flow of fluid provided by the filling system such that the flow carries the additive into the container while filling the container.

Accordingly, the injection system of the present invention can be automated such that it accommodates a plurality of fill stations by automatically actuating the valving necessary to configure the portal and inject the additive.

Optionally, a scale 37 or other level indicator may be used to monitor the amount of available additive. Such a level indicator may be integrated with the controller to sense when levels are running low or to control the amount of additive being injected.

As described above, the system of the present facilitates the injection of additives into pressurizable containers. Although the system is suitable for use with most fluids, it has been found to be particularly effective for use with halogenated compounds, especially refrigerants, such as tetrafluoroethane (HFC-134a). Furthermore, although any known additive may be injected with the system, the injection of dyes, lubricants, and/or odor agents is particularly convenient.

What is claimed is:

1. An injection system for injecting one or more additives into at least one pressurizable container for use in combination with a filling system, said filling system providing a flow of fluid from a tank of fluid to said at least one pressurizable container through a conduit, said injection system comprising:

a delivery system adapted for transferring at least one additive from a source of said one or more additives to at least one portal; and said at least one portal operatively connected to said delivery system and said filling system, said portal comprising at least:

a chamber defining an internal space having an upstream end and a downstream end relative to the flow of fluid provided by said filling system;

a first valve having a first end connected to said upstream end of said chamber, a second end connected to said delivery system, and a third end connected to at least a portion of said conduit, said first valve having at least a first position and a second position, in said first position, said delivery system is in fluid communication with said chamber and said filling system is fluidly isolated from said chamber, in said second position, said delivery system is fluidly isolated from said chamber and said filling system is in fluid communication with said chamber; and a second valve having a first end connected to said downstream end of said chamber and a second end connected to a conduit which leads to said at least one pressurizable container, said second valve having an opened and closed position;

when said first valve is in said first position and said second valve is closed, said portal has a first configuration in which said chamber is adapted to receive said one or more additives from said delivery system while being fluidly isolated from said filling system;

when said first valve is in said second position and said second valve is opened, said portal has a second configuration in which said chamber is in fluid communication with said filling system while being fluidly isolated from said delivery system wherein the flow of fluid provided by said filling system enters said upstream end of said chamber and exits said downstream end of said chamber, thereby forcing said one or more additives deposited in said chamber to be carried into said at least one pressurizable container by the flow of fluid provided by said filling system.

2. The injector system of claim 1, wherein said chamber is calibrated to quantify the volume of said internal space.

3. The injector system of claim 2, wherein said internal space is the desired volume of additive to inject in said container.

4. The injector system of claim 1, further comprising a controller, said controller being operatively connected to said portal and configured to perform the following process:

configuring said portal in said first configuration such that it is sealed from said filling system and is in fluid communication with said delivery system;

facilitating deposition of said additive in said portal by said delivery system; and configuring said portal in said second configuration such that it is sealed from said delivery system and in fluid communication with said filling system, thereby allowing any additive deposited therein to be carried into said container by the flow of fluid provided by said filling system.

5. The injector system of claim 1, further comprising:

a remote valve control system comprising:

a first actuator connected to said first valve and adapted for moving said first valve between said first position and said second position according to a control signal; and a second actuator connected to said second valve and adapted for opening and closing said second valve according to a control signal.

6. The injector system of claim 5, further comprising:

a controller electrically connected to said first and second actuators and being configured to output control signals to perform the following process:

configuring said portal in said second configuration by opening said second valve and positioning said first valve in said second position;

facilitating evacuation of the container by maintaining said portal in said second configuration for a time sufficient for said filling system to evacuate the container;

configuring said portal in said first position by closing said second valve and switching said three-way valve to a first position thereby establishing fluid communication between said delivery system and the container;

facilitating the deposition of additive in said internal space by maintaining said portal in said first configuration for a sufficient time to allow said delivery system to fill said internal space; and facilitating injection of said additive into said container by configuring said portal in said second position by switching said first valve to said second position and opening said second valve, thereby exposing said additive deposited in said internal space to the flow of fluid provided by said filling system.

7. The injector system of claim 1, wherein said delivery system comprises:

a tank for holding said additive;

delivery conduit for operatively connecting said tank to said portal; and a transfer device adapted to transfer said additive from said tank to said portal along said delivery conduit.

8. The injection system of claim 7, wherein said transfer device comprises a pump operatively disposed along said delivery conduit and adapted for pumping said additive from said tank to said chamber along said delivery conduit.

9. The injection system of claim 7, wherein at least a portion of said delivery conduit is configured as a circuit to facilitate at least partial circulation of said additive.

10. The injector system of claim 7, having a plurality of portals, and where said delivery conduit comprises:

a manifold having an inlet adapted for receiving said additive under pressure and a plurality of outlets, each outlet being connected to a branch conduit, each branch conduit being connected to a portal.

11. The injector system of claim 10, wherein said delivery conduit further comprises:

a second manifold having a plurality of inlets, each inlet being connected to a branch conduit, and an outlet operatively connected to said tank, wherein said first conduit, said branch conduit and said second conduit form a circuit to facilitate circulation of said additive.

12. The injector system of claim 7, wherein said transfer device is a metering pump and pumps a certain amount of said additive into said portal.

13. The injector system of claim 7, wherein said delivery system comprises an agitator for mixing said additive in said tank.

14. The injector system of claim 7, wherein said delivery system comprises delivery conduit pressurized with said additive.

15. The injector system of claim 7, wherein said injection system is mobile.

16. A method for injecting one or more additives into a pressurizable container connected to a filling system using an injection system, said filling system providing a flow of fluid from a tank of fluid to said pressurizable container, said injection system comprising:

a delivery system adapted for transferring one or more additives from a source of additives; and at least one portal comprising at least:

a chamber defining an internal space having an upstream end and a downstream end relative to the flow of fluid provided by said filling system;

a first valve having a first end connected to said upstream end of said chamber, a second end connected to said delivery system, and a third end connected to at least a portion of said conduit, said first valve having at least a first position and a second position, in said first position, said delivery system is in fluid communication with said chamber and said filling system is fluidly isolated from said chamber, in said second position, said delivery system is fluidly isolated from said chamber and said filling system is in fluid communication with said chamber; and a second valve having a first end connected to said downstream end of said chamber and a second end connected to a conduit which leads to said pressurizable container, said second valve having an opened and closed position;

said method comprising:

(a) configuring said first valve in said first position and said second valve in said closed position such that said chamber is fluidly isolated from said filling system and is in fluid communication with said delivery system;

(b) transferring said one or more additives from said source of additives into said chamber;

(c) configuring said first valve in said second position and said second valve in said opened position such that said chamber is fluidly isolated from said delivery system and is in fluid communication with said filling system; and (d) operating said filling system to allow the flow of fluid, provided by said filling system, to enter said upstream end of said chamber and to exit said downstream end of said chamber, and thereby force said one or more additives deposited in said chamber to be carried into said pressurizable container.

17. The method of claim 16, wherein, in step (c), a sufficient amount of fluid passes through said portal such that substantially no additive residue remains.

18. The method of claim 16, wherein said additive is selected from the group consisting of dye, lubricant, and mixtures thereof.

19. The method of claim 16, wherein said fluid is a halogenated compound.

20. The method of claim 19, wherein said fluid is a refrigerant.

21. The method of claim 20, wherein said fluid is HFC-134a.

* * * * *